US009241871B2

(12) United States Patent
Intini et al.

(10) Patent No.: US 9,241,871 B2
(45) Date of Patent: Jan. 26, 2016

(54) CONTAINER

(76) Inventors: Thomas D. Intini, Brossard (CA); Derek Intini, Calgary NW (CA)

( * ) Notice: Subject to any disclaimer, the term of this patent is extended or adjusted under 35 U.S.C. 154(b) by 0 days.

(21) Appl. No.: 13/261,802

(22) PCT Filed: Jul. 20, 2012

(86) PCT No.: PCT/CA2012/000688

§ 371 (c)(1),
(2), (4) Date: May 29, 2015

(87) PCT Pub. No.: WO2013/010264

PCT Pub. Date: Jan. 24, 2013

(65) Prior Publication Data

US 2015/0283028 A1 Oct. 8, 2015

(30) Foreign Application Priority Data

Jul. 20, 2011 (CA) ..... 2746907

(51) Int. Cl.

| | |
|---|---|
| ***B65D 83/04*** | (2006.01) |
| ***A61J 1/03*** | (2006.01) |
| ***B65D 50/00*** | (2006.01) |
| ***B65D 55/02*** | (2006.01) |
| ***B65D 63/10*** | (2006.01) |
| ***B65D 43/16*** | (2006.01) |

(52) U.S. Cl.

CPC ..... *A61J 1/03* (2013.01); *B65D 43/162* (2013.01); *B65D 50/00* (2013.01); *B65D 55/02* (2013.01); *B65D 63/10* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,889,238 | A * | 12/1989 | Batchelor | B65D 43/169 206/232 |
| 5,860,550 | A * | 1/1999 | Miller | B65D 25/54 206/535 |
| 7,111,733 | B1 * | 9/2006 | Foote | A45C 11/26 206/528 |
| 7,900,772 | B2 * | 3/2011 | Sack | A61J 1/035 206/1.5 |
| 8,220,636 | B2 * | 7/2012 | Beecroft | B65D 83/0472 206/1.5 |
| 8,616,376 | B2 * | 12/2013 | Cronin | B65D 83/04 206/1.5 |
| 2012/0080350 | A1 * | 4/2012 | Powell | A45C 13/10 206/528 |

* cited by examiner

*Primary Examiner* — Jacob K Ackun
(74) *Attorney, Agent, or Firm* — Eric Fincham

(57) ABSTRACT

A package for a pharmaceutical product comprising a bottom member (12) having a base (20) and at least one wall (18) extending upwardly therefrom, a cover member (22) a first locking arrangement (38) on both said cover member (22) and said bottom member (12), the locking arrangement being located on respective adjoining walls (14, 28) on the cover member (22) and the bottom member (12), a second locking arrangement (56) between the bottom member (12) and cover member (22) permitting limited movement between the cover member (22) and bottom member (12) while mainlining a locking relationship such that the first locking arrangement (38) may be moved from a locked to an unlocked position while the second locking arrangement (56) remains locked, a tether (68) mounted within the container (10) and a plurality of medicant containing packages (78) mounted on the tether (68) in a non removable manner. The package permits one to package otherwise non child resistant packages in a child resistant and senior friendly container.

6 Claims, 4 Drawing Sheets

CONTAINER

FIELD OF THE INVENTION

The present invention relates to containers and more particularly, relates to a container which has child resistant properties and is also senior friendly.

BACKGROUND OF THE INVENTION

The use of child resistant packaging is well known in the art and is utilized for many different types of products. Primarily, this package is used for those products which represent a potential hazard in the hands of children—i.e. medicaments and the like. The approach adopted for the child proofing of the packaging primarily depends upon the product—i.e. its size, format, etc. Thus, for example, in the field of pharmaceuticals many different types of pill containers which have locking tops are well known and are widely used commercially. Similarly, individually packaged medicaments are often sealed in different types of blister packages which are designed to prevent easy access by children.

Although very effective child packages can be designed, it is also important that the package is capable of being opened without undue difficulty by the average consumer for whom the product is intended. Thus, this is frequently a problem in that one of the major groups of medicament users are the elderly and packaging which relies on a certain amount of strength to open is often self defeating in that the end users find it difficult or impossible to open such packaging.

A related problem occurs when medication is sent from the pharmacy or other dispensing operation to the end user. This frequently occurs in more remote locations and one must choose suitable packaging again balancing the requirements set forth above with respect to the package being child resistant but senior friendly.

SUMMARY OF THE INVENTION

It is an object of the present invention to provide child resistant packaging which is also senior friendly and which may be utilized in different manners.

According to one aspect of the present invention, there is provided a package arrangement for a pharmaceutical product comprising a bottom member, the bottom member having a base and at least one wall extending upwardly therefrom, a cover member, a first locking arrangement on both the cover member and the bottom member, the first locking arrangement being located on respective adjoining walls of the cover member and the bottom member, a second locking arrangement between the bottom member and the cover member permitting limited movement between the cover member and bottom member while maintaining a locking relationship such that the first locking arrangement may be moved from a locked to an unlocked position while the second locking arrangement remains locked, a tether mounted within the container, a plurality of medicament containing packages mounted on the tether, the medicament containing packages being mounted in a non removable manner to the tether, the tether being fixedly secured at either end thereof.

The present invention provides packaging which may be utilized for a number of different products although a primary use is the medical field where child resistant and senior friendly features are important. It is a container which can hold a number of different products such as blister packs, sachets and pouches. The key feature is that the different products which it can hold are neither child resistant nor senior friendly. However, by retaining the blister packs, sachets and pouches inside the container of the present invention, these packages are rendered child resistant and senior friendly. In order to achieve the above, it is important that the packages be retained within the container and are not removable. Access may be had to them to dispense the required amount of medication.

The container is preferably formed as a one piece unit and may be of a suitable plastic material such as polyethylene or polypropylene. The package is also designed to be used as a mailer for retaining pharmaceuticals which are then forwarded by courier or the mail service to the end user. The package utilizes dust prevention inner side flanges.

In general, the packaging includes a bottom container member which is adapted to receive and contain the articles to be packaged. This bottom container member may be of any conventional configuration and may be generally characterized as having a base portion with at least one wall extending upwardly therefrom to form a container adapted to receive and retain the products therein. At the upper end of the walls is a mouth portion through which the contents of the bottom container may be accessed.

A covering member covers the mouth of the container and which will be of a configuration to match that of the bottom container member. Although the cover can be a separate member, in a preferred embodiment it is formed with the container bottom and is hingedly connected thereto through a living hinge. The cooperative locking arrangement associated with the cover and the container bottom preferably comprises first and second locking arrangements. Although both locking arrangements function to retain the cover in the closed position, the first locking arrangement allows limited movement between the cover member and the bottom container member such that the second locking arrangement may be unlocked while the first locking arrangement maintains a locked position or relationship. By so doing, one can move the first locking arrangement from a locked to an unlocked position while the second locking arrangement is still in its locked position. One must then perform a second sequential operation to unlock the second locking arrangement to permit removal of the cover from the mouth of the container and permit access to the contents thereof. This two part sequential operation provides effective child resistant features for this embodiment.

In one embodiment, the cooperative locking arrangement comprises a tab formed in one of the cover or bottom members and a recess formed on the other of the members. For purposes of discussion herein, the tab member will be referred to as being on the bottom container member while the recess will be described as being formed in the cover member. It will be understood that the reverse situation may also apply and indeed, combinations of the same may be utilized as will become apparent from the description herein.

In the preferred embodiment, the second locking arrangement comprises at least one tab member and one recess formed on a side of the container. More preferred is the arrangement wherein the second locking arrangement comprises a pair of locking devices on opposed sides of the container with the first locking arrangement being located on the front of the container.

In the preferred arrangement, the first locking arrangement comprises a tab member extending upwardly from the front wall of the bottom member with the tab being formed integrally as a portion of the package. The tab preferably has an outwardly extending flange at an upper portion thereof which will fit with within a recess formed within the front wall of the cover member. The formation of the tab per se and the operation thereof is conventional as with known tab locking devices. Operation of the first locking arrangement to unlock the container consists of an inward pressure applied on the front wall of the bottom portion proximate the tab member to thereby urge the tab member from its engagement with the recess and thereby permit movement of the cover.

To provide the sequential steps for the child resistant features for the above embodiment, the second locking arrangement are located on the side of the container. Preferably, identical locking devices on opposed sides are provided. The preferred embodiment again utilizes a tab extending upwardly from the marginal edge of the side walls of the bottom member and recesses located in the side walls of the cover member. The recesses may be formed in the side walls or in one embodiment, may merely consist of apertures with which the tab member engages and enters into a locking relationship.

The locking devices of the second locking arrangement provide for a limited movement of the cover member vis a vis the bottom member when in a locked position. In other words, the engagement of the tab member with the recess still permits a limited upward movement of the cover member. With this arrangement, the first locking arrangement may be unlocked and the cover member moved upwardly to prevent relocking thereof while the second locking arrangement remains in a locked position.

Furthermore, the arrangement is such than when pressure is exerted on the front wall of the bottom member proximate the tab member to move it out of locking relationship with the corresponding recess, this pressure transmits a force to the side walls of the bottom member which in turn tends to force the tab member(s) of the second locking arrangement into tighter engagement with their corresponding recesses. Thus, barring the use of unusual force, all the locking devices cannot be opened simultaneously.

In a still further embodiment of the invention, two side locks hold a rotating rod, to which non child resistant/senior friendly sachets and pouches are attached. The $30^{th}$ day sachet is taped to the centre rod. The remaining 29 day sachets are rolled around so that when the centre rod lock is snapped into its socket, the centre rod can easily rotate and each day a pouch containing medicaments can be removed by tearing the sachet along the perforation or cutting with scissors.

In a further embodiment of the invention, a somewhat smaller version of the package may be employed. In this version, there is only provided locking arrangements on opposed sides of the container. However, the container is dimensioned so as to make it difficult for a child to open the same—i.e. the distance between the locking arrangements is such that a single hand cannot be used to operate the opposed locking devices.

In the preferred embodiments of the present invention, the locking mechanism is designed such that it may be used by pharmacies as a mailer for medicine delivered to residences through the mail system. This may be done by utilizing a substantially hermetically sealed arrangement.

In a further embodiment, the container will have a pop up feature whereby when the top center area of the base portion is depressed, the lip will pop up from the first locking arrangement and automatically rise to the level wherein the side locks may be opened.

In a still further embodiment of the invention, the container may be provided with a partially flexible locking member or tether which is secured between the top and the bottom of the package. The locking member would first be inserted into the injection molded base lock which is part of the bottom wall. The blister packs could be fed through the locking member by means of holes in the blister card following which the other end of the locking member would be inserted into an injection molded lid lock which is part of the inner lid. Once the locking member is inserted into the lock, it cannot be removed. This converts the secondary package into a primary package which would be recognized by FDA as a total F1 primary package.

Once the blisters are locked in, the cover is closed and locked. When opened, the blisters can be flipped out and the tablets pushed through each of the blisters as indicated thereon which may be printed with a monthly dosage regime.

In another preferred embodiment, the package will have an inside flange all around the side locks, to make the container a dust resistant mailer package.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
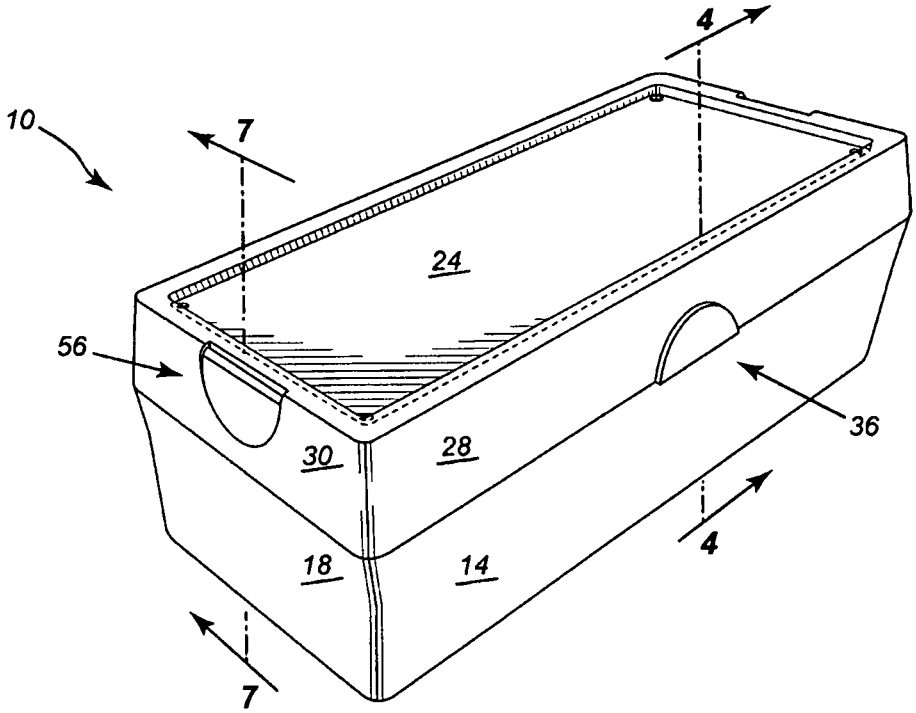
FIG. 1 is a perspective view of a container according to the present invention.

Referring to the drawings in greater and by reference characters thereto, there is illustrated a container generally designated by reference numeral 10. Container 10 includes a bottom portion generally designated by reference numeral 12 and a cover generally designated by reference numeral 22.

Bottom portion 12 has a front wall 14, a rear wall 16, a pair of side walls 18 and a base 20.

Cover 22 has a top wall 24, a rear wall 26 and a front wall 28. A pair of side walls 30 are provided. Cover 22 is connected by means of living hinges 32 which extend between rear wall 26 of cover 10 and rear wall 16 of bottom portion 12. Located interiorly of bottom portion 12 are reinforcing ribs 34.

A first locking arrangement is generally designated by reference numeral 38 and is located on front walls 14 and 28 of the bottom portion 12 and cover 22 respectively. The first locking arrangement includes a flange 40 extending inwardly from front wall 28 of cover 22.

Formed in front wall 14 of bottom portion 12 is a recess generally designated by reference numeral 46 and which includes a shoulder 48. Flange 40 is adapted to seat within recess 46 with flange 40 mating or engaging with shoulder 48. The resulting locking action provides for a secure retention.

To open the container, inward pressure is applied as indicated by arrow 54. The tab member moves from its original position inwardly to thereby release the tab from recess 46 and permit continued upward movement of the cover as indicated by arrow 52.

A second locking arrangement is provided and comprises a pair of locking devices 56 and 56'. Devices 56 and 56' are identical and only one will be described herein.

Locking device 56 has an inwardly extending tab 58 from side wall 18; tab 58 includes a tapered portion generally designated by reference numeral 62. Formed in side wall 30 of cover member 22 is a recess or aperture 64 into which tab 58 sits to provide a locking relationship between the bottom member 12 and cover 22. It is to be noted that aperture 64 of side wall 30 is sized to be somewhat larger than the corresponding portion of tab 58 to thereby allow limited upward movement of cover member 22 while still maintaining a locking relationship. To open the second locking arrangement 56, inward pressure is exerted as indicated by the arrow 61.

Figure 6A:
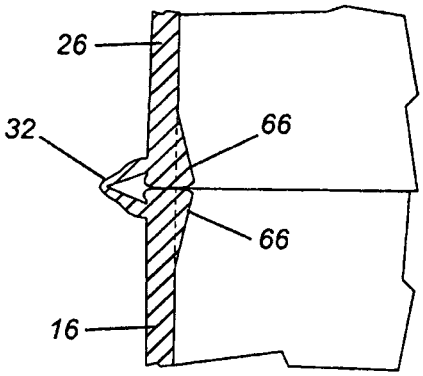
FIGS. 6A and 6B illustrate the living hinge when in a closed and partially opened position respectively.
Figure 6B:
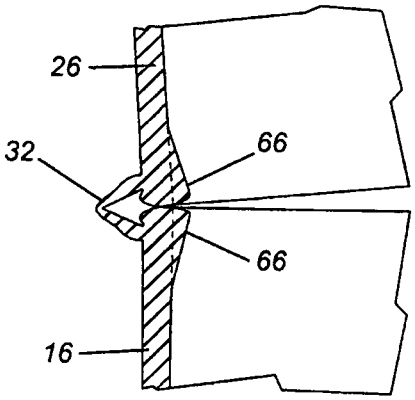

As may be seen in FIGS. 6A and 6B, molded pressure extensions 66 are provided and cause an upward pressure to be exerted on cover 22.

Figure 3:
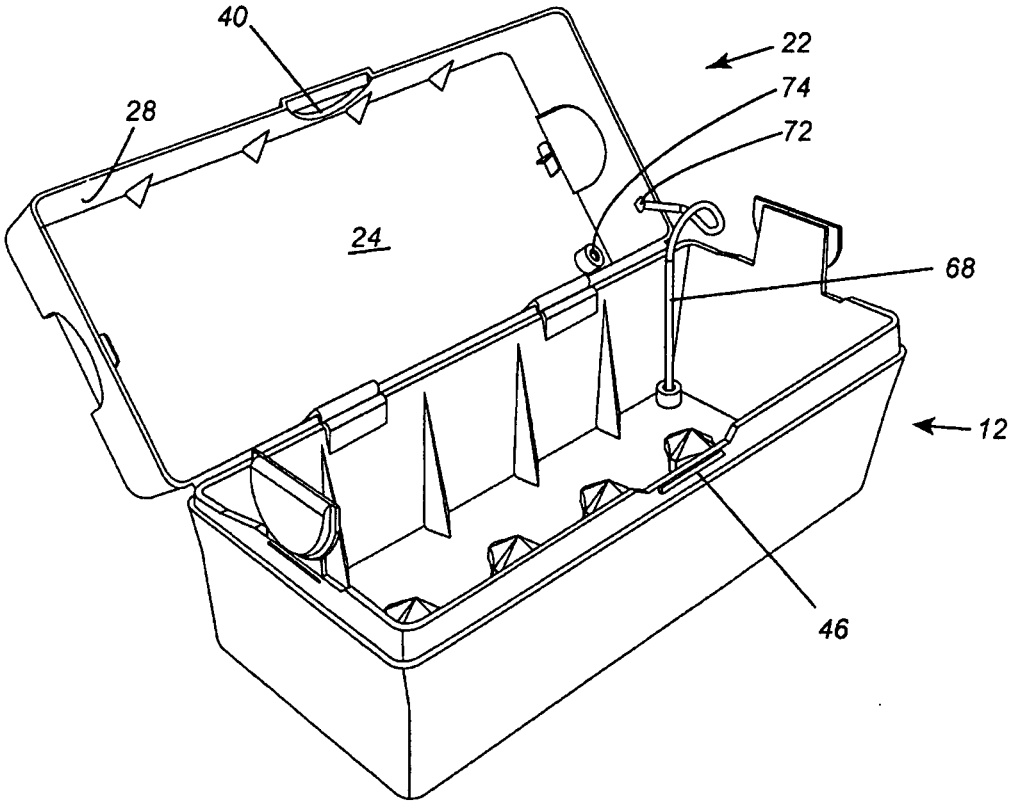
FIG. 3 is a view similar to FIG. 2 illustrating a tethering arrangement for the container.
Figure 4:
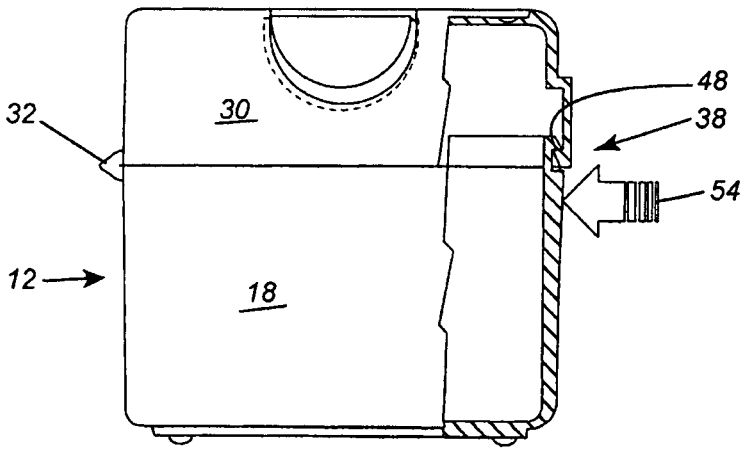
FIG. 4 is a partial cutaway view along the lines 4-4 of FIG. 1.
Figure 5:
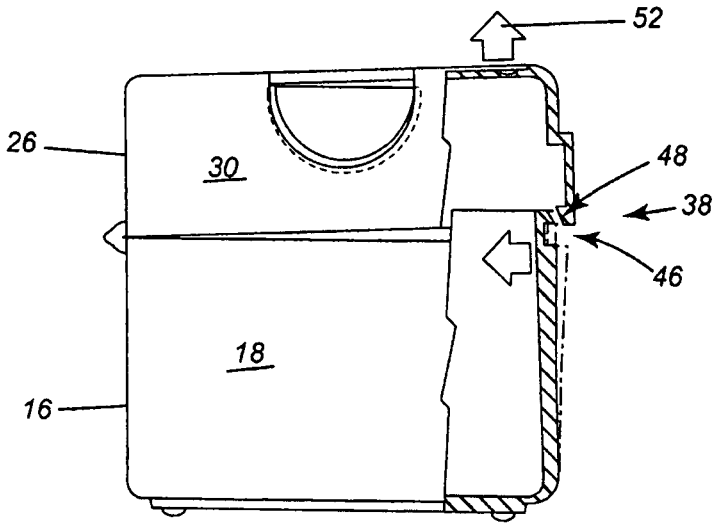
FIG. 5 is a view similar to FIG. 4 illustrating the opening of the container.
Figure 7:
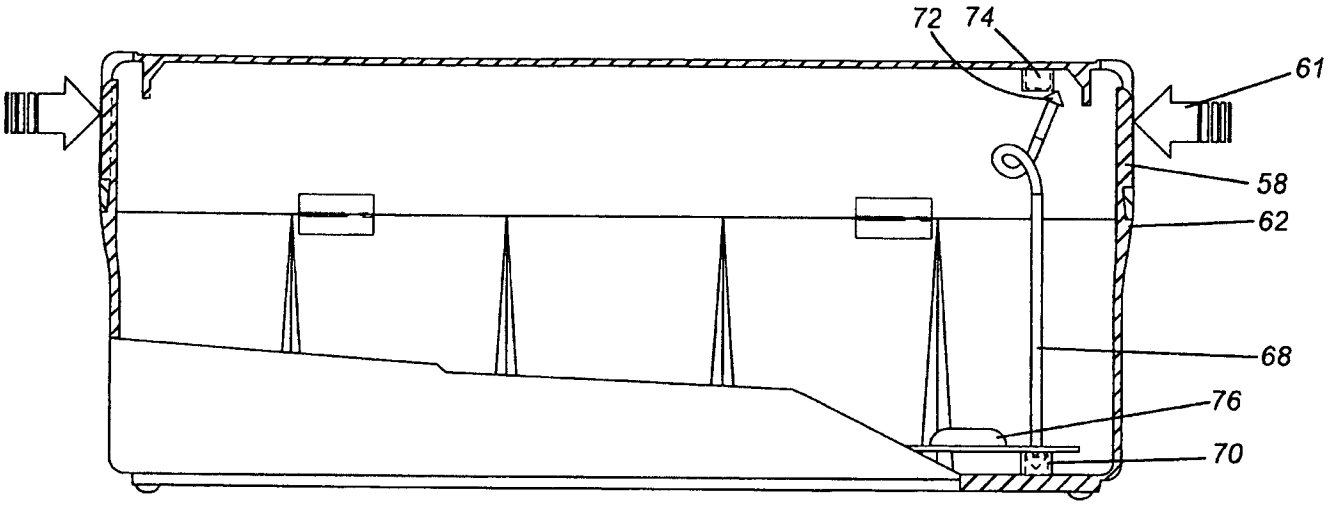
FIG. 7 is a sectional view taken along the lines 7-7 of FIG. 1.
Figure 8:
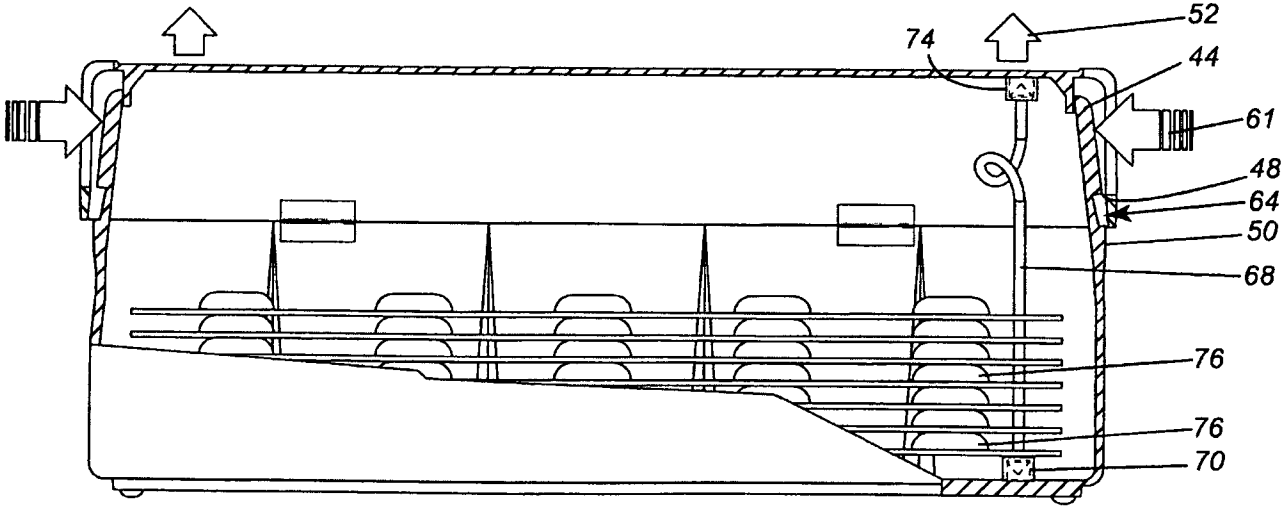
FIG. 8 is a view similar to FIG. 8 showing the medicaments having been placed in the container.

As may be seen in FIGS. 3, 7 and 8, a tether 68 is provided. A first end 70 of tether 68 is secured to base 20. A second end 72 has a conical configuration and is designed to fit within a locking recess 74 formed on the underside of cover 22.

Tether 68 is designed to retain a plurality of blister packs 76 as may be seen in FIG. 8. The flexible portion and length of tether 68 permits the opening of cover 22 and provides access to blister pack 76. However, blister pack 76 cannot be removed from tether 68 and thus this renders the arrangement to be childproof. A flange 78 provides a hermetic seal.

Figure 2:
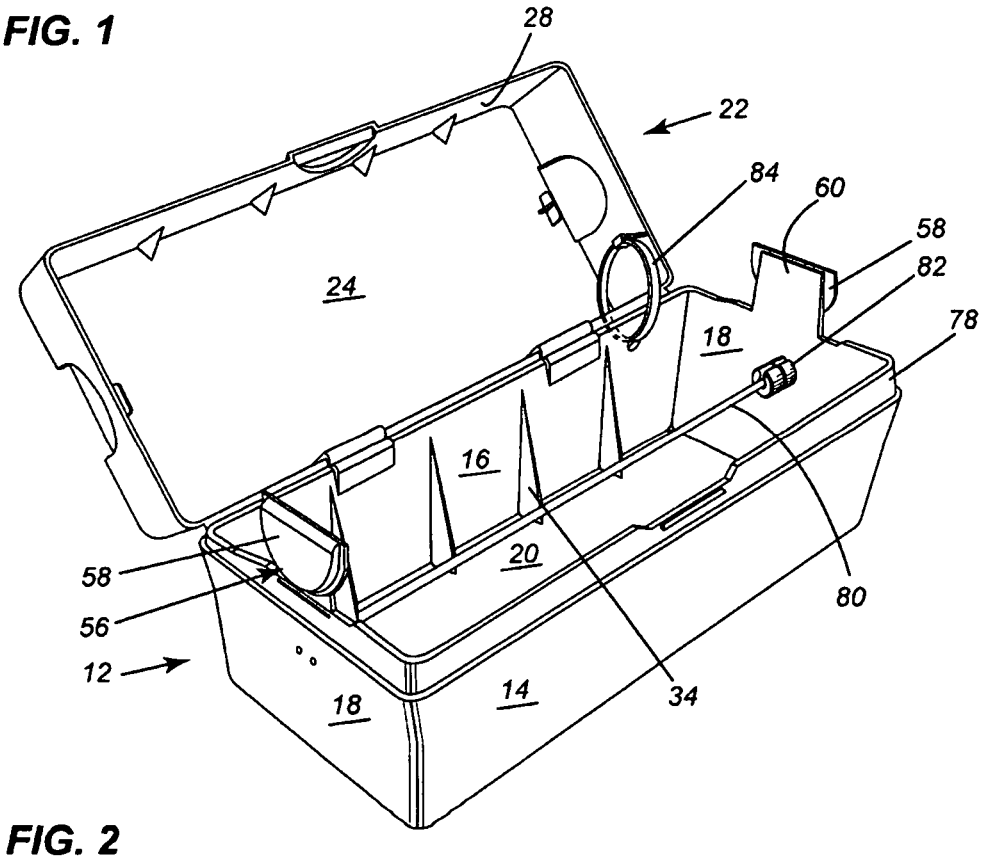
FIG. 2 is a perspective view showing the container in the open position.

As shown in FIG. 2, the device may include a rotatable bar lock 80 which is held by two side locks 82 (only one shown). The side locks have a generally U-shaped recess to receive bar 80. This is convenient for sachets when the pharmaceuticals for a single day are packaged in a sachet. The $30^{th}$ day sachet is taped to the centre rod and the remaining 29 day sachets are rolled around so that when the centre rod lock is snapped into its socket the rod can easily rotate. Each day a pouch containing the medicaments for the day can be removed by tearing the sachet along a perforation or alternatively cutting with scissors. Alternatively, a tie member 84 could be utilized; tie member 84 being of the tooth and rachet type.

We claim:

1. A package arrangement (10) for a pharmaceutical product comprising:

a bottom member (12), said bottom member (12) having a base (20) and at least one wall (18) extending upwardly therefrom;

a cover member (22);

a first locking arrangement (38) on both said cover member and said bottom member, said first locking arrangement (38) being located on respective adjoining walls (14, 28) of said cover member (22) and said bottom member (12);

a second locking arrangement (56) between said bottom member (12) and said cover member (22) permitting limited movement between the cover member (22) and bottom member (12) while maintaining a locking relationship such that the first locking arrangement (38) may be moved from a locked to an unlocked position while said second locking arrangement (56) remains locked;

a tether (68) mounted within said container (10), a plurality of medicament containing packages (76) mounted on said tether, said medicament containing packages being mounted in a non removable manner to said tether, said tether being fixedly secured at either end thereof.

2. The package arrangement of claim 1 wherein said tether (68) comprises a flexible cable.

3. The package arrangement of claim 1 wherein said tether (68) is a solid rod (80) retained by a locking mechanism.

4. The package arrangement of claim 1 further including a flange extending about an upper portion of said bottom member to hermetically seal with said cover.

5. The package arrangement of claim 4 wherein said bottom member (12) and said cover member (22) are formed of a material selected from polyethylene and polypropylene.

6. The package arrangement of claim 1 further including molded pressure extensions (66) on said bottom member rear wall (16) and said top member rear wall (26), said molded pressure extensions (66) placing an upward pressure on said cover (22).

* * * * *